US007641560B1

(12) United States Patent
Sikra

(10) Patent No.: US 7,641,560 B1
(45) Date of Patent: Jan. 5, 2010

(54) TAKE-UP IN DRUM ACTUATION DRIVE TRAINS

(75) Inventor: Richard A. Sikra, Thousand Oaks, CA (US)

(73) Assignee: Drum Workshop, Inc., Oxnard, CA (US)

( * ) Notice: Subject to any disclaimer, the term of this patent is extended or adjusted under 35 U.S.C. 154(b) by 381 days.

(21) Appl. No.: 11/581,277

(22) Filed: Oct. 16, 2006

(51) Int. Cl.
*G10D 13/02* (2006.01)

(52) U.S. Cl. ..... 464/132; 84/422.1

(58) Field of Classification Search ..... 464/119, 464/132, 136; 384/513, 515, 537, 540; 84/422.1–422.3
See application file for complete search history.

(56) References Cited

U.S. PATENT DOCUMENTS 4,538,499 A * 9/1985 Livingston ..... 84/422.1
5,204,485 A * 4/1993 Lombardi ..... 84/422.1
6,513,984 B1 * 2/2003 Hobaugh, II ..... 384/537

FOREIGN PATENT DOCUMENTS

GB 2 135 425 A * 8/1984
JP 60-234125 * 11/1985

OTHER PUBLICATIONS

Machinery's Handbook, 25th ed., New York, International Press, 1996. p. 2239. TJ151.M3 1996.*

* cited by examiner

*Primary Examiner*—Greg Binda
(74) *Attorney, Agent, or Firm*—William W. Haefliger

(57) ABSTRACT

A linkage coupling a drum foot pedal rotor to a drum beater apparatus comprising in combination an elongated link, a first universal joint coupling the rotor to the link, and a second universal joint coupling the link to the apparatus, at least one of the universal joints coupling first and second components relatively rotatable about a transverse axis, two transversely spaced bearings carried by the first component, each bearing including annular inner and outer races and bearing balls located between the races, there being members tightly coupling the inner races to the second component at transversely spaced locations, whereas the inner races are offset transversely relative to the outer races to thereby clamp the balls transversely between the races, and immobilizing means joining the outer races to the first component, and/or the members to the second component.

7 Claims, 4 Drawing Sheets

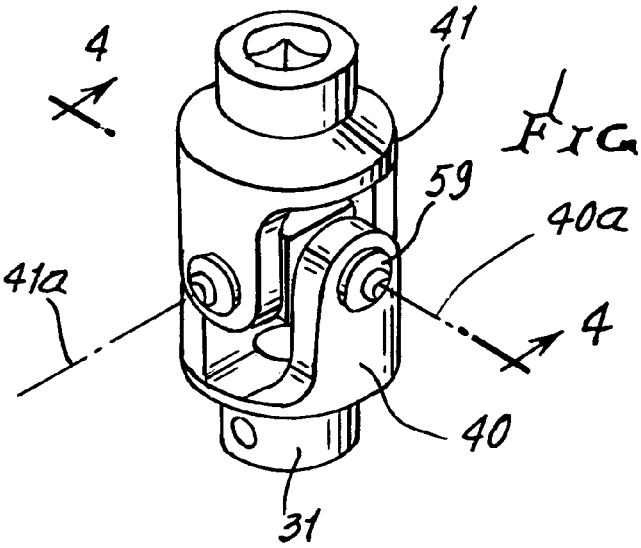
FIG. 2.
FIG. 3.
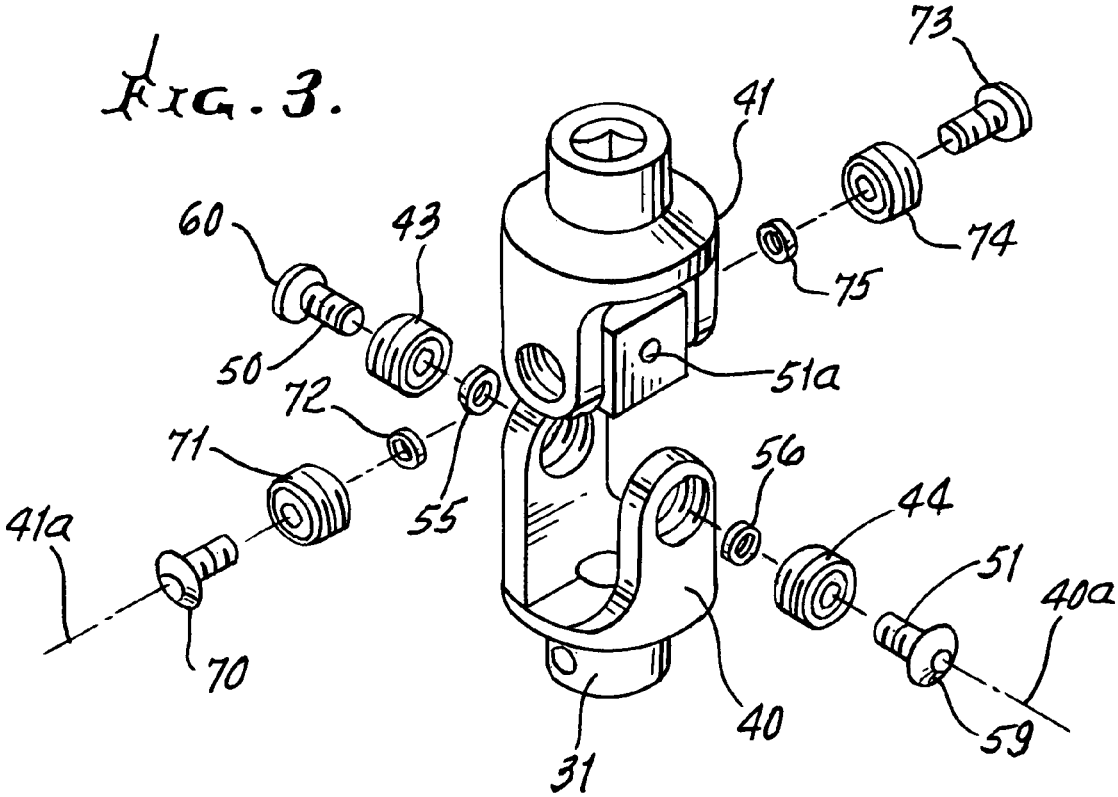

TAKE-UP IN DRUM ACTUATION DRIVE TRAINS

BACKGROUND OF THE INVENTION

This invention relates generally to rotary drives between drum foot pedal rotors and drum beaters, and more particularly concerns elimination of play between mechanical coupling elements located between such rotors and drum beaters.

The use of foot pedals remote from drum beaters introduces associated play between such coupling elements, resulting in loss of precise timing of drum beating in response to operation of foot pedals. Such play can occur when one or more universal joints is in the drive train of elements between the drum foot pedal and the drum beaters. There is need for coupling that removes any such unwanted play, to enhance precise timing of drum beating during musical performances.

SUMMARY OF THE INVENTION

It is a major object of the invention to provide a drive train element coupling which meets the need referred to. Basically the invention is embodied in a linkage coupling a drum foot pedal rotor to a drum beater apparatus comprising in combination, the following listed elements:

a) an elongated link;

b) a first universal joint coupling the rotor to said link, and a second universal joint coupling the link to said apparatus;

c) at least one of said universal joints coupling first and second components relatively rotatable about a transverse axis;

d) two transversely spaced bearings carried by the first component, each bearing including annular inner and outer races and bearing balls located between said races there being members tightly coupling the inner races to the second component at transversely spaced locations, whereby the inner races are offset transversely relative to the outer races to thereby clamp the balls transversely between the races;

e) and immobilizing means joining i) the outer races to the first component, and/or ii) the members to the second component.

As will be seen, the assured immobilizing means typically and preferably consists of cured adhesive material.

Another object is to provide spacers held clamped between said inner races and said second component, such spacers typically being ring shaped, and acting to limit offsetting of the inner races relative to the outer races so as to prevent excessive bearing ball misalignment during clamp-up.

Yet another object is and provides said members in the form of fasteners having threaded connections to said inner races and to said second component, said adhesive contacting said threaded connection. A further object is to provide threading joining the outer races to the first component, said immobilizing means consisting of cured adhesive adherent to interconnected threading.

An added object is to provide a press fit connection joining the outer races to the first component, said immobilizing means consisting of cured adhesive adherent to said press fit connection defined by interengaged cylindrical surfaces.

These and other objects and advantages of the invention, as well as the details of an illustrative embodiment, will be more fully understood from the following specification and drawings, in which:

DRAWING DESCRIPTION

FIG. 2 is an enlarged perspective view shown a universal joint in the linkage;

FIG. 3 is a view like FIG. 2 showing an exploded view of universal joint elements;

DETAILED DESCRIPTION

Figure 1:
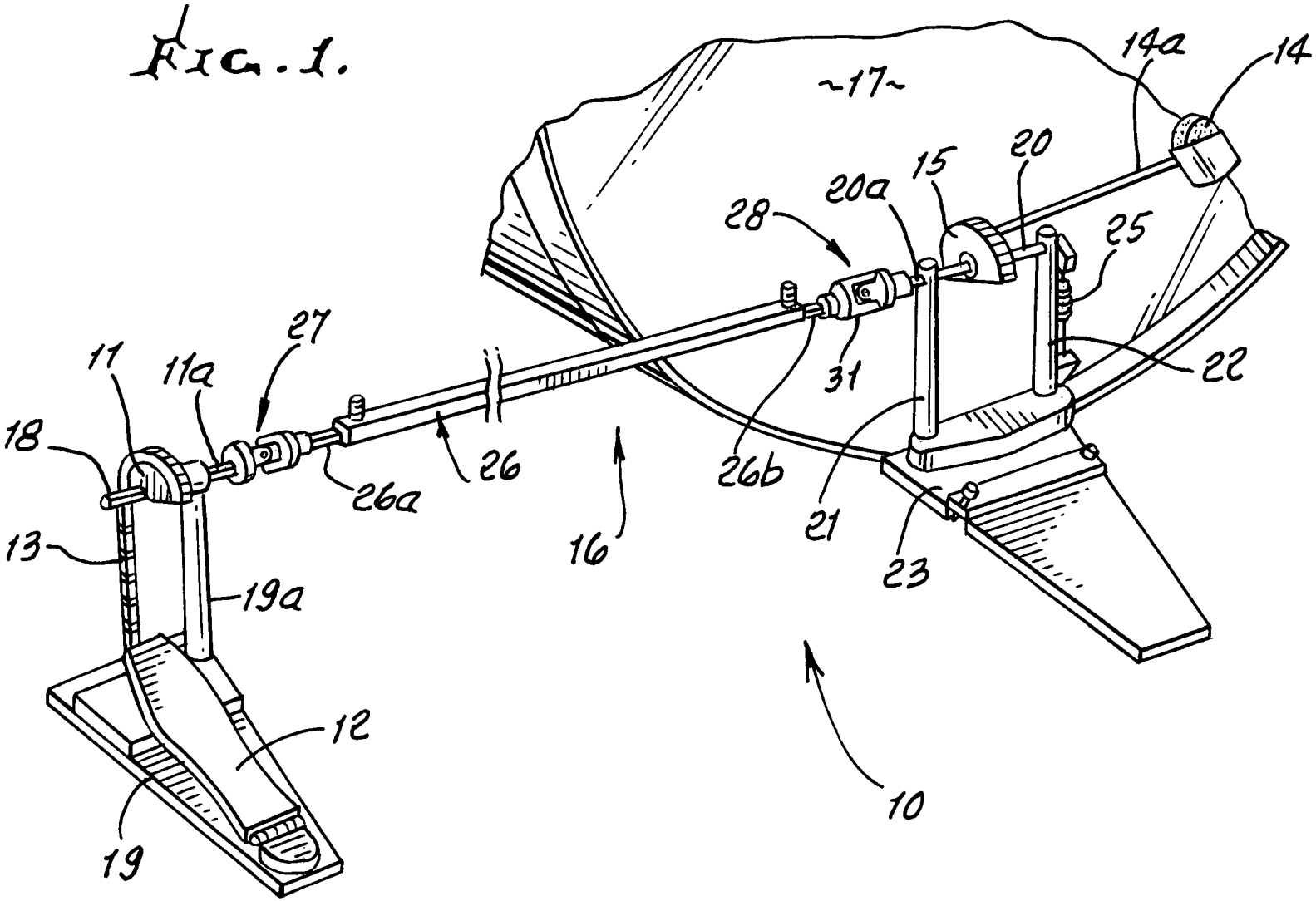
FIG. 1 is a perspective view showing a linkage between a foot pedal operated drive rotor and a remote drum beater.

In FIG. 1, the assembly 10 includes one form of a rotor 11 driven by a foot pedal 12 and chain 13, a drum beater 14 on a rotor 15, and a linkage 16 coupling the remotely separated rotors 11 and 15. A drum to be struck by the beater is shown at 17. Rotor 11 is carried by an axle 18 supported by a pedestal 19*a* on a base plate 19. A chain connects pedal 12 to the rotor 11 in the form of a sprocket. Rotor 15 is carried by an axle 20 supported by pedestals 21 and 22 on base plate 23. As the pedal 12 is pushed downward, the rotors 11 and 15, the axle 18, the linkage 16, and axle 20 rotate, to cause the beater shaft 14*a* and beater 14 to rotate upwardly to strike the drum. A tension spring 25 connected to axle 20 causes the axle to reversely rotate along with elements 16 and 18, to return the beater to the position shown.

The linkage 16 is shown to include an elongated rod 26 and two universal joints 27 and 28, each having multiple elements with clearances between them, as will be referred to. Joint 27 is typically connected to a projection 11*a* from axle 11 and a projection 26*a* from rod 26; and joint 28 is typically connected to a projection 20*a* from axle 20 and a projection 26*b* from the rod 26. See the representative set screw 30 attaching hub 31 of joint 28 to 26*b*, in FIG. 4.

A preferred universal joint, as at 28, in FIG. 2, includes first and second components 40 and 41, which are relatively swingable, universally relative to one another. U-shaped component 40 defines an axis 40*a* of pivoting, and component 41 defines an axis 41*a*, those transverse axes extending normal to one another.

Figure 4:
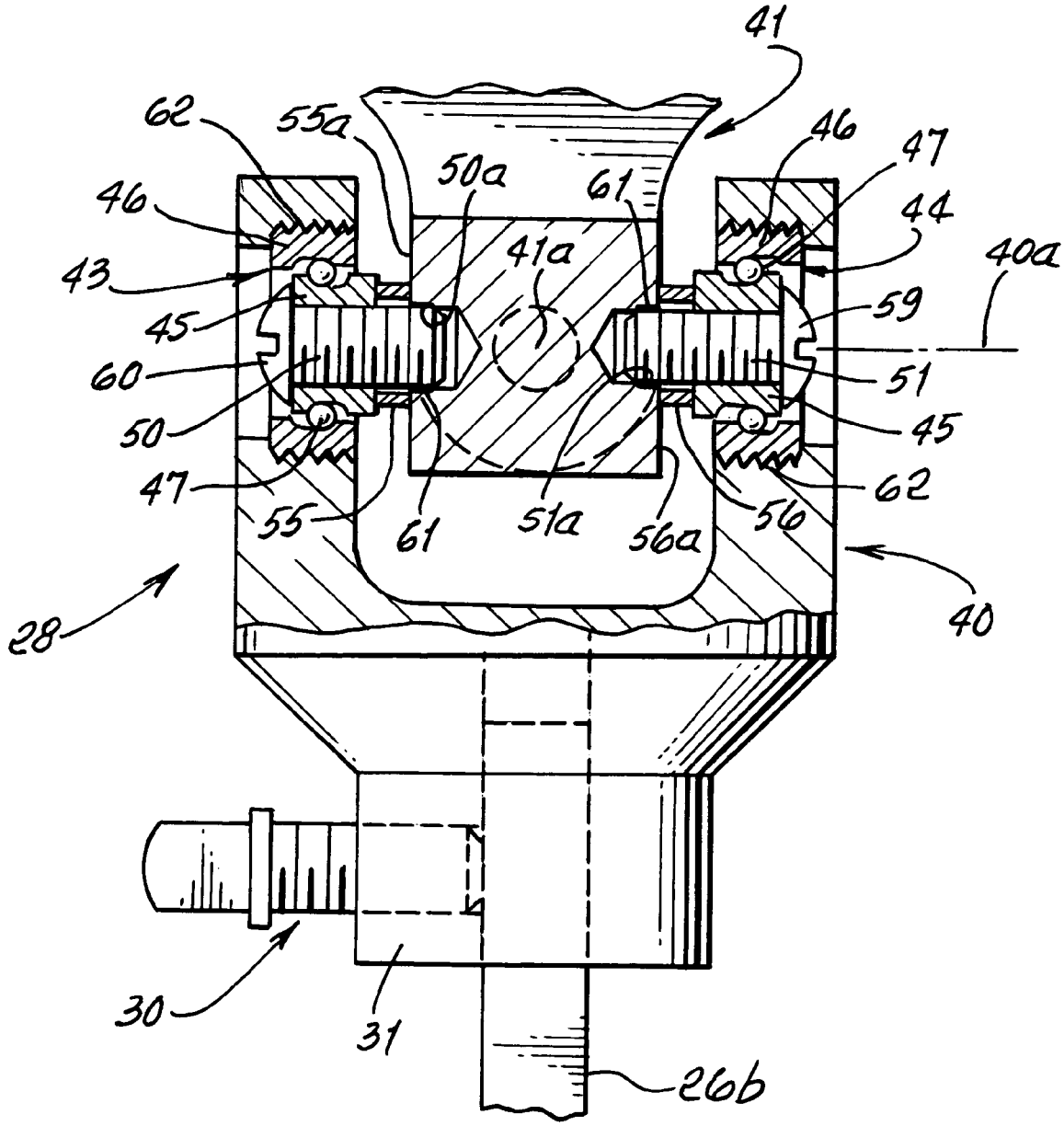
FIG. 4 is a further enlarged view, taken in section on lines 4-4 of FIG. 2.

Two transversely spaced bearings 43 and 44 are carried by first component 40, as shown in FIG. 4. Each bearing includes inner and outer races 45 and 46, and a ring of bearing balls 47 (or rollers) that are located between and engage the races, whereby component 41 may swivel about axis 40*a* relative to component 40. Such bearings normally have clearances between bearing elements, and the totality of clearances in each of the universal joints represents a slight but objectionable time elapse factor between foot actuation of pedal 12, and beater movement response to strike the drum, due to needed take-up of such clearances to effect desired response.

FIG. 4 shows provision of screw threaded members 50 and 51 coupling the inner races to the second component 41, at transversely spaced locations. Tightening of the members into threads 50*a* and 51*a* provided in bores in component 41 effects transverse displacement of the inner races 45 relative to the outer races, as shown to cause the balls 47 to roll up on walls of the bearing races and eliminate or take-up any clearances associated with the bearing that would otherwise contribute to beater actuation time-factor elapse, as referred to. Such tightening is controlled and aided by the provision of clamp-up spacer rings 55 and 56 between the inner races and the walls 55*a* and 56*a* of the second component 41 referred to. Heads 59 and 60 are provided on the members 51 and 50 to exert force against sides of the inner races, as shown.

In addition, immobilizing means is provided, joining the outer races to the first component and/or joining the threaded members to the second component 41. Typically, and preferably, the immobilizing means consists of cured adhesive material which may be applied to surfaces of such elements in liquid state, and then allowed to cure, to lock the elements in position against dislodgement during rotary play of the drumming equipment. The immobilizing adhesive typically contacts screw thread surface or connection to lock together interfitting threads. One preferred adhesive consists of an epoxide. See adhesive at 61 and 62.

Figure 5:
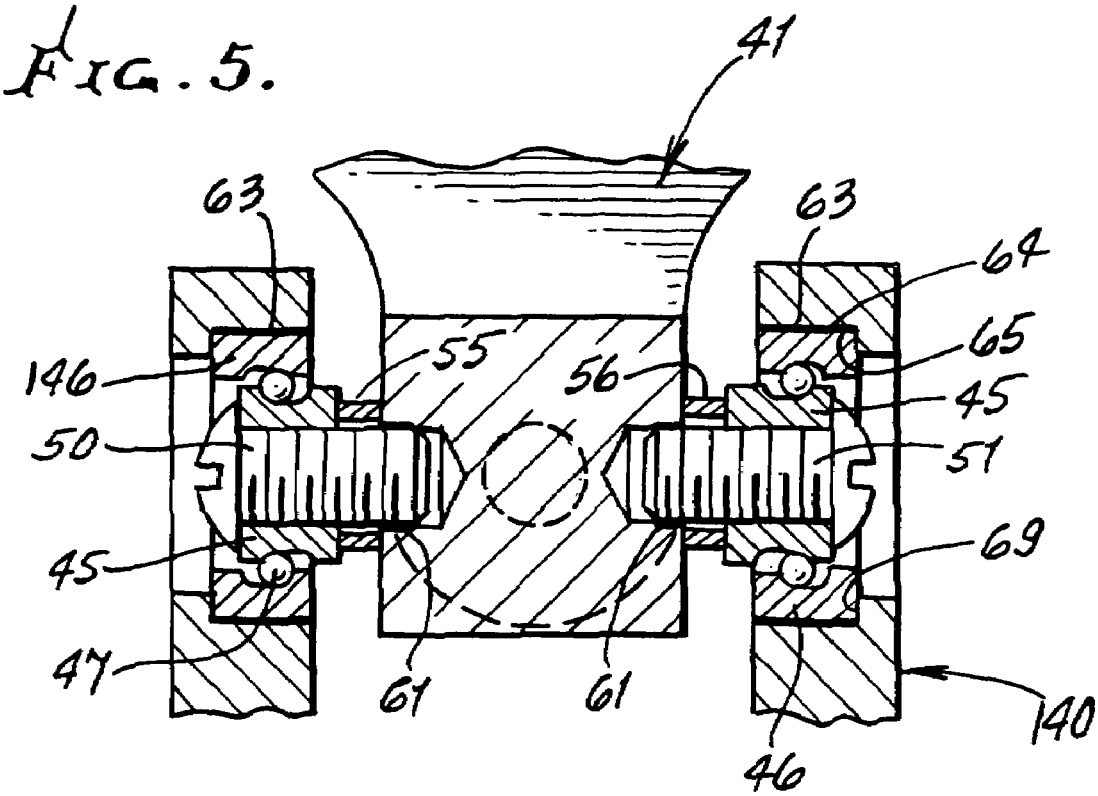
FIG. 5 is a view like FIG. 4, showing a modification.
Figure 6:
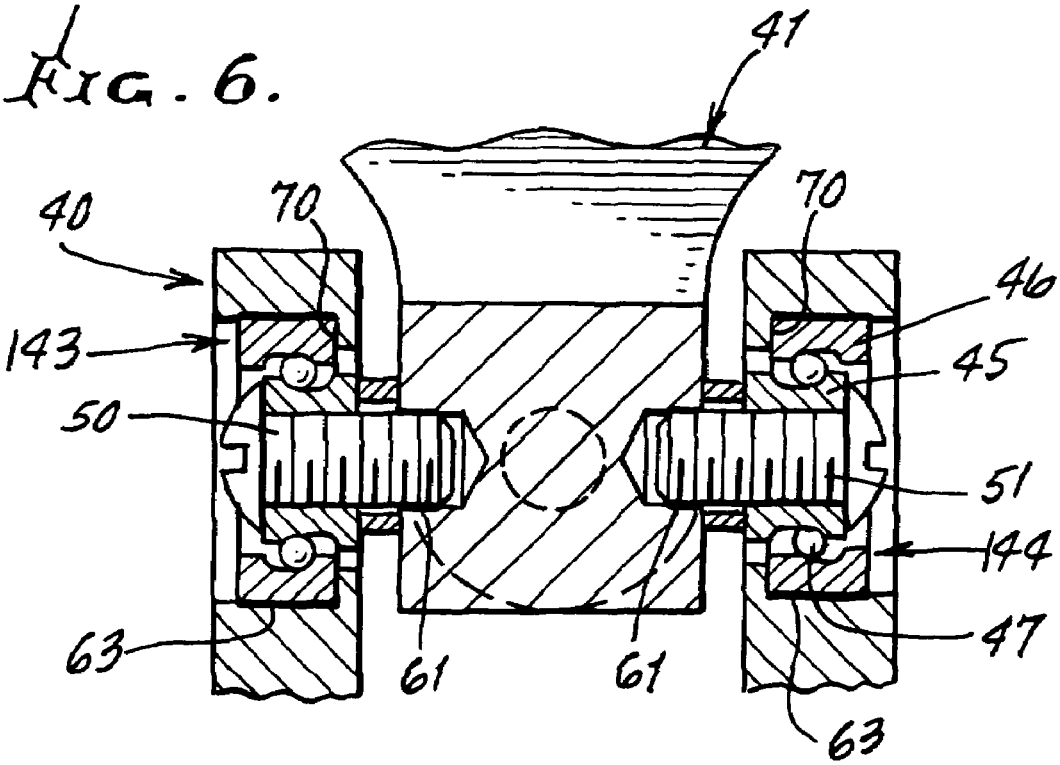
FIG. 6 is a view like FIG. 5 showing a further modification.

FIG. 5 is like FIG. 4, except that the adhesive 63 contacts interfitting (for example press fit) cylindrical surfaces at 64 and 65, blocking transverse movement of the outer races relative to the first component 140. Outer races 146 are endwise positioned by shoulders 69 on component 140. FIG. 6 is like FIG. 5 except that shoulders 70 on 40 engage end walls of the outer races 144 closest to component 41. See also bearings 143 and 144.

Further members and adhesive may be provided at all bearing locations associated with the universal joints, i.e. from bearing location at each of the two joints, to maximize clearance take-up.

including immobilizing means joining i) the additional outer races to the first component, and/or ii) the additional members to the second component.

FIG. 3 also shows elements 70-72 respectively corresponding to 51, 55 and 56, and elements 73-75 respectively corresponding to 50, 43 and 55.

I claim:

1. A linkage coupling a drum foot pedal rotor to a drum beater apparatus comprising in combination a) an elongated link, b) a first joint coupling the rotor to said link, and a second joint coupling the link to said apparatus, c) at least one of said joints having first and second joint components relatively rotatable about a transverse axis, d) two transversely spaced bearings carried by the first component, each bearing including annular inner and outer races and bearing balls located between said races, there being members coupling the inner races to the second component at transversely spaced locations, whereby the inner races are offset transversely relative to the outer races to thereby clamp the balls transversely between the races, and against curved oppositely facing sidewalls defined by the races to thereby take up any clearances associated with the bearings that would contribute to beater actuator time factor elapse, e) and immobilizing means joining i) the outer races to the first component, and/or ii) the members to the second component.

2. The combination of claim 1 including spacers held clamped between said inner races and said second component.

3. The combination of claim 2 wherein said spacers comprise rings.

4. The combination of claim 1 wherein said members comprise fasteners having threading connections to said inner races and to said second component, said adhesive contacting said threading connections.

5. The combination of claim 1 including spacers held clamped between said inner races and said second component, said spacers located proximate said cured adhesive material.

6. The combination of claim 1 including interconnected threading joining the outer races to the first component, said cured adhesive adherent to interconnected threading.

7. The combination of claim 1 whereby a press fit connection joining joins the outer races to the first component, said cured adhesive adherent to said press fit connection defined by interengaged cylindrical surfaces.

* * * * *